US010800569B2

(12) United States Patent
de Cleir et al.

(10) Patent No.: US 10,800,569 B2
(45) Date of Patent: Oct. 13, 2020

(54) CLOSURE AND FINISH FOR SMALL CARBONATED BEVERAGE PACKAGING WITH ENHANCED SHELF LIFE PROPERTIES

(71) Applicants: THE COCA-COLA COMPANY, Atlanta, GA (US); BERICAP SC LLC, Cowpens, SC (US)

(72) Inventors: Piaras de Cleir, Marietta, GA (US); Frank Gehindy, Wiesbaden (DE); Lothar Brauer, Budenheim (DE); Simon Shi, Marietta, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 31 days.

(21) Appl. No.: 15/500,271

(22) PCT Filed: Jul. 31, 2015

(86) PCT No.: PCT/US2015/043262

§ 371 (c)(1),
(2) Date: Jan. 30, 2017

(87) PCT Pub. No.: WO2016/019321

PCT Pub. Date: Feb. 4, 2016

(65) Prior Publication Data

US 2017/0210503 A1 Jul. 27, 2017

Related U.S. Application Data

(60) Provisional application No. 62/032,423, filed on Aug. 1, 2014.

(51) Int. Cl.

| | |
|---|---|
| ***B65D 1/02*** | (2006.01) |
| ***B65D 41/04*** | (2006.01) |
| ***B65D 51/16*** | (2006.01) |

(52) U.S. Cl.
CPC ..... *B65D 1/0223* (2013.01); *B65D 1/023* (2013.01); *B65D 1/0246* (2013.01); *B65D 41/04* (2013.01);
(Continued)

(58) Field of Classification Search
CPC .. B65D 1/0223; B65D 51/1622; B65D 41/04; B65D 1/0246; B65D 1/023; B65D 41/0414; B65D 41/0428; B65D 1/02
See application file for complete search history.

(56) References Cited

U.S. PATENT DOCUMENTS

| | | | |
|---|---|---|---|
| 3,954,003 | A | 5/1976 | Dobbins |
| 4,392,055 | A | 7/1983 | Whitney |

(Continued)

FOREIGN PATENT DOCUMENTS

| | | | |
|---|---|---|---|
| AU | 2011100050 | A4 | 2/2011 |
| GB | 2322123 | A | 8/1998 |

(Continued)

OTHER PUBLICATIONS

PCO-1881 voluntary standard 28mm CSD finish, International Society of Beverage Technology, Internet publication time: Jul. 31, 2012) URL: https://www.bevtech.org/assets/committees/packaging-technology/20/3784253-20.pdf (Year: 2012).*

(Continued)

*Primary Examiner* — James N Smalley
(74) *Attorney, Agent, or Firm* — Eversheds Sutherland (US) LLP

(57) ABSTRACT

This disclosure provides new closure and finish structures suited for small and light-weight carbonated beverage packaging that provide surprisingly improved carbonation retention and greater shelf life, while still achieving light weight. This closure and finish presented herein are particularly suited to small PET containers for carbonated beverages, for (Continued)

example less than or about 400 mL and provide good carbonation retention and shelf life.

24 Claims, 13 Drawing Sheets

(52) U.S. Cl.
CPC ..... *B65D 41/0414* (2013.01); *B65D 51/1622* (2013.01); *B65D 1/02* (2013.01); *B65D 41/0428* (2013.01)

(56) References Cited

U.S. PATENT DOCUMENTS

| | | | | |
|---|---|---|---|---|
| 4,476,987 | A * | 10/1984 | Nolan | B65D 41/3466 215/270 |
| 4,539,852 | A | 9/1985 | Feld | |
| 4,545,496 | A * | 10/1985 | Wilde | B29C 57/00 215/252 |
| 4,721,220 | A | 1/1988 | Northup | |
| 4,738,370 | A | 4/1988 | Urmston et al. | |
| 5,738,231 | A * | 4/1998 | Montgomery | B65D 55/02 215/230 |
| 6,347,545 | B1 | 2/2002 | Osborn et al. | |
| 6,544,609 | B1 * | 4/2003 | Goldman | B29C 47/003 428/35.7 |
| 2008/0067142 | A1 * | 3/2008 | Druitt | B65D 41/04 215/324 |
| 2009/0045158 | A1 * | 2/2009 | Suriol | B65D 41/0407 215/256 |
| 2013/0056436 | A1 | 3/2013 | Muto et al. | |
| 2018/0134462 | A1 * | 5/2018 | Dreyer | B65D 41/3442 |

FOREIGN PATENT DOCUMENTS

| | | | |
|---|---|---|---|
| JP | H10281959 | A | 10/1998 |
| WO | 2008095842 | A1 | 8/2008 |
| WO | 2014108781 | A1 | 7/2014 |

OTHER PUBLICATIONS

Description of AU 2011100050 provided by Espacenet. (Year: 2020).*
PCT International Search Report and Written Opinion for International Application No. PCT/US2015/043262 dated Nov. 24, 2015.
Third Party Observation in EP 15826708.8, Mar. 28, 2019, pp. 1-7.
International Society of Beverage Technologists (ISBT) Voluntary Standard Test Methods for PET Bottles (Issue Date: Oct. 2003, Revision 1).
First Office Action issued by the Chinese Patent Office for Application No. 201580052908.X, dated Jul. 10, 2018.
Second Office Action issued by the Chinese Patent Office for Application No. 201580052908.X, dated May 5, 2019.
Decision of Rejection issued by the Chinese Patent Office for Application No. 201580052908.X, dated Jan. 15, 2020.
India Office Action for 2017-17007062, dated Apr. 30, 2020 (5 pp.).
Examination Report No. 1 for Australian Application No. 2015296081, dated May 7, 2019 (5 pp.).
Examination Report No. 2 for Australian Application No. 2015296081, dated Dec. 23, 2019 (4 pp.).
Extended European Search Report for European Application No. 15826708.8, dated Feb. 22, 2018 (11 pp.).

* cited by examiner

CLOSURE AND FINISH FOR SMALL CARBONATED BEVERAGE PACKAGING WITH ENHANCED SHELF LIFE PROPERTIES

CROSS REFERENCE TO RELATED APPLICATIONS

This application is a 35 U.S.C. § 371 National stage application of International Patent Application No. PCT/US2015/043262, filed Jul. 31, 2015, which claims the benefit of priority from U.S. Provisional Application No. 62/032,423, filed Aug. 1, 2014, which is incorporated herein by reference in its entirety.

TECHNICAL FIELD

This disclosure relates to polymer-based packaging for carbonated beverages, particularly to the closure and finish for the carbonated beverage packaging.

BACKGROUND

Polyethylene terephthalate and its copolyesters (hereinafter referred to collectively as "PET") are widely used to make containers for carbonated soft drinks, juice, water, and the like due to their excellent combination of clarity, mechanical, and gas barrier properties. In spite of these desirable characteristics, oxygen and carbon dioxide gas barrier properties of PET limit the application of PET for smaller sized packages, as well as for packaging oxygen sensitive products, such as beer, juice, and tea products. A widely expressed need exists in the packaging industry to further improve the gas barrier properties of smaller sized containers.

However, in smaller containers when the finish height and diameter are reduced it can become more difficult to grip the closure to open the package, a problem that is worsened when lightweighting the package. Therefore, there is a continuing need for small packages at lower weights that have improved shelf-life and physical performance. Specifically for the closure, such performance improvements are needed for leakage, permeation, openability, blow-off and other physical parameters over a broad range of temperatures from cold-to-hot.

SUMMARY

Various PET containers have been used for carbonated soft drinks for a number of years and PET resin and container designs have been optimized for carbonation retention. Factors contributing to package performance such as thermal stability and shelf life include bottle and closure permeation, bottle creep, PET sorption and closure loss through permeation and leakage around the closure seals. This disclosure relates generally to improved container finish and closure designs that will further limit carbon dioxide loss and thereby enhance shelf life, particularly in small carbonated beverage packaging. The improved container finish and closure designs are also useful in non-carbonated beverage packaging, such as used for water, juice, tea, coffee, soy or flavored milk, non-carbonated alcoholic beverages, alcoholic beverages and the like.

Generally, closure permeation loss through the closure itself is determined by available closure surface area, thickness, material type, and processing parameters. Closure loss through permeation and leakage around the closure seals is determined by seal interface design, pressure differential and material properties at ambient and higher or lower temperatures. Particular problems arise with small packaging, where generally it has been found that oxygen and carbon dioxide gas barrier properties become more influential as the package volume decreases, and a substantial portion of the degradation in shelf life is attributed to the closure and finish of the small packaging.

Therefore, one aspect of this disclosure is aimed to develop improved package designs, including the finish and closure, at lower overall weights without compromising shelf life and physical performance. Specifically for the closure this includes leakage, permeation, openability, blow-off and other physical parameters over a broad range of temperatures from cold-to-hot. For example, when an International Society of Beverage Technologists (ISBT) standard 28 mm PCO 1881 finish is reduced proportionally from a 500 mL or larger bottle to a smaller bottle such as a 250 mL or 300 mL bottle, it has been unexpectedly discovered that when certain of the PCO 1881 finish dimensions are reduced proportionally and certain PCO 1881 finish dimensions are reduced in a non-proportional manner, the shelf life of the resulting bottle can be significantly enhanced.

In a further example, it has been discovered that when a standard 28 mm PCO 1881 finish is reduced proportionally from a 500 mL or larger bottle to a smaller bottle such as a 250 mL or 300 mL bottle, it has been unexpectedly discovered that when certain PCO 1881 finish dimensions are reduced proportionally and certain PCO 1881 finish dimensions are not reduced in a proportional manner, the shelf life of the resulting bottle can be significantly enhanced. As an example of a standard finish that is used as the starting point for reducing finish dimensions either proportionally or non-proportionally, the standard 28 mm PCO 1881 finish is a single start finish that includes a thread start of 1.70 mm, thread pitch of 2.70 mm, thread turn of 650°, a neck weight of 3.74 g, and having the following dimensions: T, 27.40 mm; C, 21.74 mm; X, 17.00 mm; and Z, 33.0 mm.

In some aspects, the inventive closure can be described as being generated by technically: 1) reducing the PCO 1881 finish dimensions proportionally based on the size of the reduced finish opening, to form a theoretical or nominal intermediate finish; followed by 2) increasing and/or decreasing selected finish dimensions of the reduced proportion intermediate finish. In one useful aspect, the inventive closure can be described as being generated by technically: 1) reducing the PCO 1881 finish dimensions proportionally based on the size of the reduced finish opening, to form a theoretical or nominal intermediate finish; followed by 2) increasing selected finish dimensions of the reduced proportion intermediate finish. Reference is made to FIGS. 1-4 of this disclosure that sets out exemplary modifications of a PCO 1881 finish according to this disclosure.

Other particular and unexpected problems arise upon reducing the dimensions of a bottle or container for carbonated beverages, beyond what would be expected from simply increasing the surface area to volume ratio and consequently generating a higher relative rate of carbon dioxide loss. For example, when the finish height and diameter are reduced in the small packaging, it can become much more difficult to grip the closure for the purpose of opening the package. In one aspect, for example, a 26 mm water bottle closure with a reduced height (10 mm) was found to be quite difficult to open due to the minimized gripping area and the lack of an optimized knurling pattern. One aspect of this disclosure provides a unique knurling design and pattern which can be effectively utilized to overcome this challenge. Such an improved knurling design and pattern can become more important the thinner the "E-wall" becomes due to lightweighting.

In a further aspect, the inventive closures also may include novel combinations with specific types of tamper evident bands, also termed pilfer proof rings or seals. For example, the novel reduced dimension finish which includes some proportionally reduced and some non-proportionally sized finish dimensions, can be advantageously combined with a "folded" pilfer proof ring. Alternatively, the novel reduced dimension finish which includes some proportionally reduced and some non-proportionally sized finish dimensions, can be advantageously combined with an "inserted band" pilfer proof ring.

These and other aspects, embodiments, examples and illustrations of the present invention will be evident from the figures and detailed description that follow.

DETAILED DESCRIPTION

According to an aspect of this disclosure, there are provided improved package designs for small carbonated beverage bottles, including improved finish and closure designs that provide lower overall weights without compromising shelf life and physical performance. Specifically, for small bottles (less than or about 400 mL) based on proportionally reducing the size of a 500 mL bottle having a standard 28 mm PCO 1881 finish, it has been unexpectedly found that when certain of the PCO 1881 finish dimensions are reduced proportionally and certain PCO 1881 finish dimensions are reduced in a non-proportional manner, the physical properties and performance of the resulting bottle can be significantly enhanced. In some small bottle finishes, actually increasing the size of certain PCO 1881 finish dimensions while reducing others provides enhanced shelf life and performance features. These improved results are enhanced with the combination of the specifically dimensioned finish dimensions with certain tamper evident bands.

Figure 1:
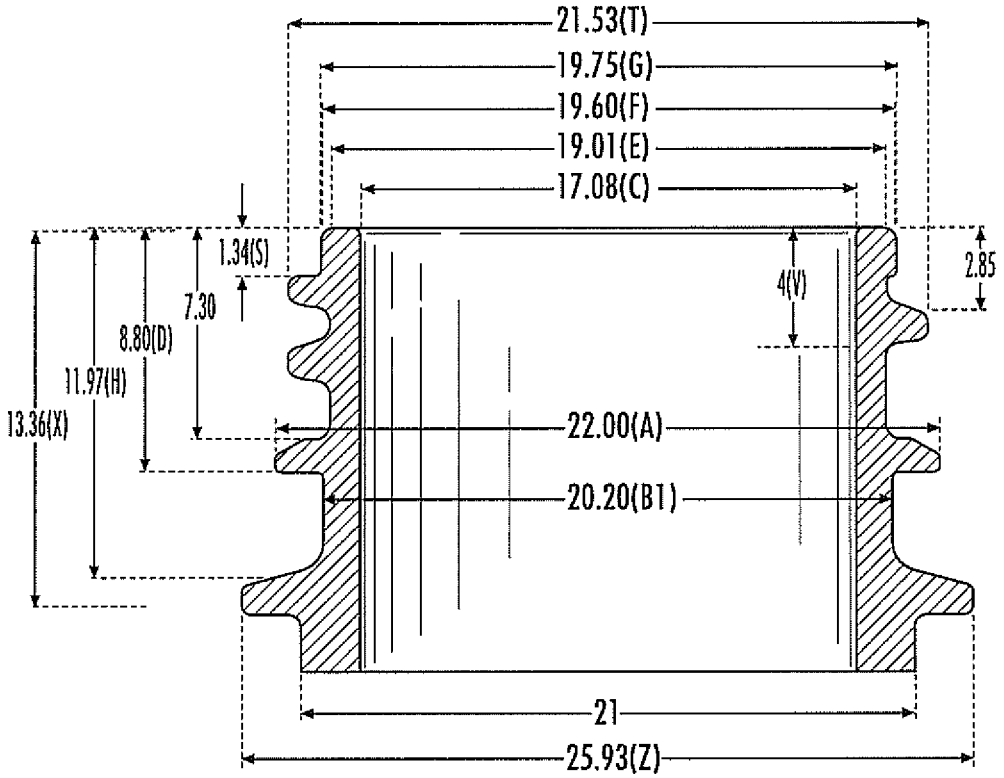
FIG. 1 illustrates a PCO 1881 finish with dimensions in millimeters that has been proportionally scaled down to a T dimension (thread outside of the diameter) of 22 mm (nominal). Further illustrating the thread start at 2.85 mm and the straight on blow bottle at 21 mm.
Figure 2:
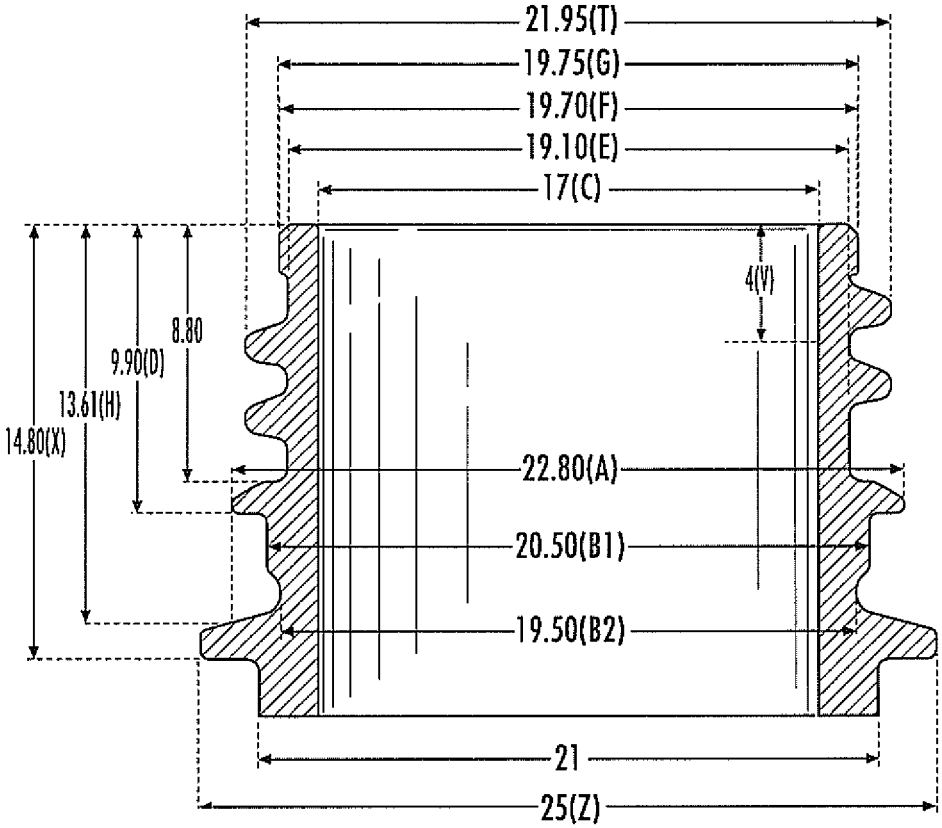
FIG. 2 shows the proportionally scaled down PCO 1881 finish of FIG. 1 with dimensions in millimeters having a T dimension (thread outside of the diameter) of 22 mm, with a B1 collar (20.5 mm) added. Therefore the B1 diameter is greater than the B diameter immediately below the collar.
Figure 3:
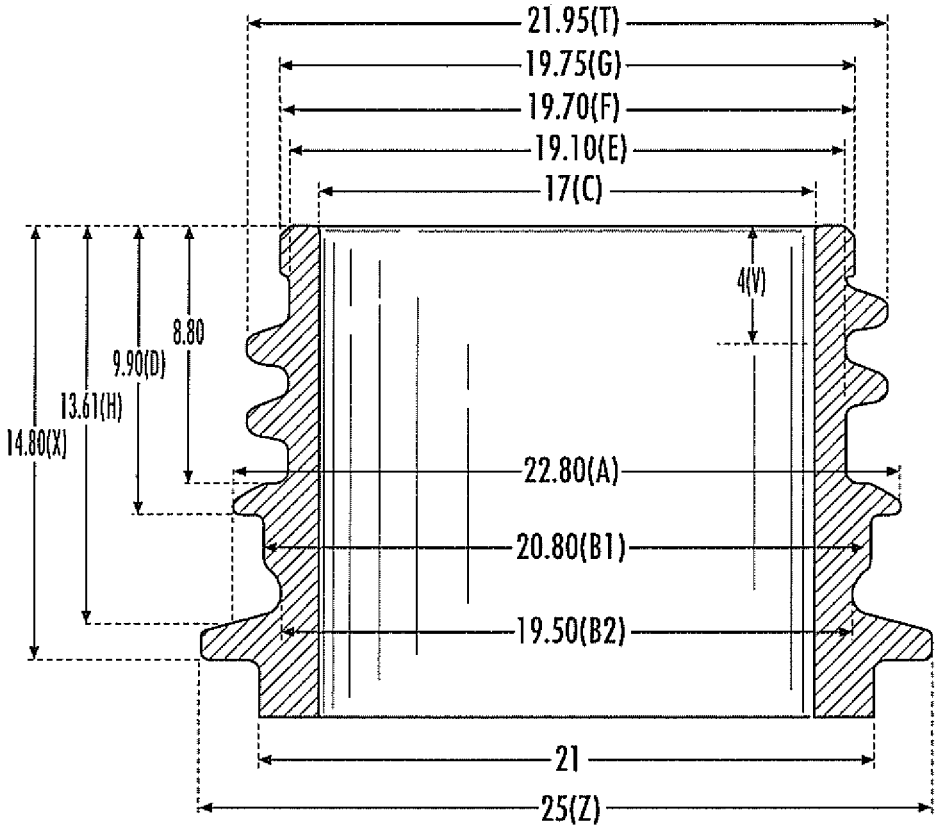
FIG. 3 shows the proportionally scaled down PCO 1881 finish of FIG. 1 with dimensions in millimeters having a T dimension (thread outside of the diameter) of 22 mm, with a B1 collar added having a diameter increased to 20.8 mm.
Figure 4:
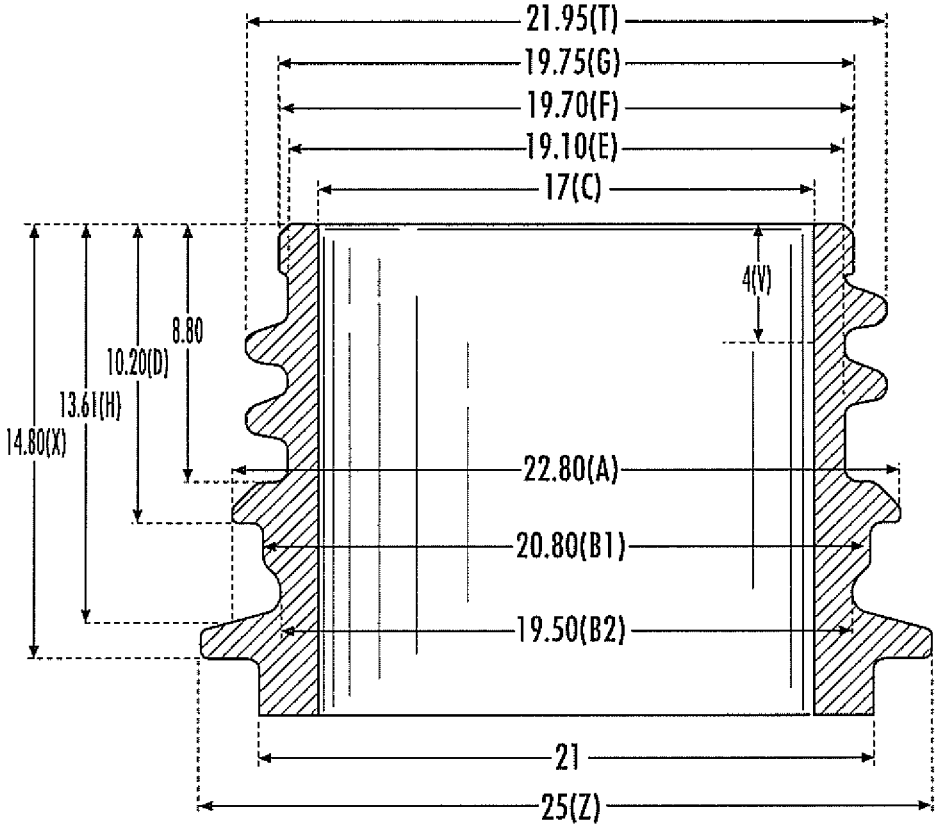
FIG. 4 shows the shows the proportionally scaled down PCO 1881 finish of FIG. 3 with dimensions in millimeters with a T dimension of 22 mm and a B1 collar having a diameter increased to 20.8 mm, with the D dimension increased to 10.2 mm for greater security and operability with the Tamper Evident (TE) seal or band.

FIGS. 1-4 set out exemplary modification of a PCO 1881 finish according to this disclosure with measurements in millimeters. FIG. 1 illustrates a PCO 1881 finish that has been proportionally scaled down to a T dimension (thread outside of the diameter) of 22 mm (nominal). FIG. 2 shows the proportionally scaled down PCO 1881 finish of FIG. 1 having a T dimension (thread outside of the diameter) of 22 mm, with a B1 collar (20.5 mm) added. Therefore the B diameter is greater than the B diameter immediately below the collar. FIG. 3 shows the proportionally scaled down PCO 1881 finish of FIG. 1 having a T dimension (thread outside of the diameter) of 22 mm, with a B1 collar added having a diameter increased to 20.8 mm. Finally, FIG. 4 shows the shows the proportionally scaled down PCO 1881 finish of FIG. 3 with a T dimension of 22 mm and a B1 collar having a diameter increased to 20.8 mm, with the D dimension increased to 10.2 mm for greater security and operability with the Tamper Evident (TE) seal or band. In each case of FIG. 2-4, shelf life is improved and better finish and closures are provided as compared with the FIG. 1 finish example.

Figure 5A:
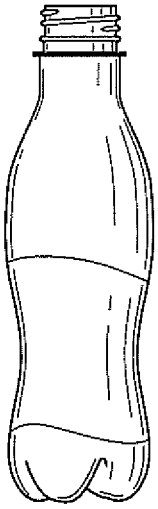
FIG. 5A through FIG. 5E illustrates five currently used small bottles designated A through E, corresponding to FIG. 5A through FIG. 5E, respectively, used for baseline testing for physical performance, as shown in Table 1. That is, Bottle A is illustrated at FIG. 5A, Bottle B is illustrated at FIG. 5B, etc. The data from these bottles was used for developing the inventive closure and finish of this disclosure. Bottles A and E have a proportionally scaled down 1873 finish, and bottles B, C, and D have a proportionally scaled down 1881 finish.
Figure 5B:
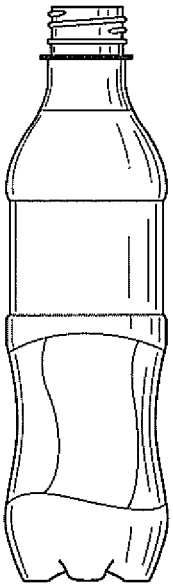
Figure 5C:
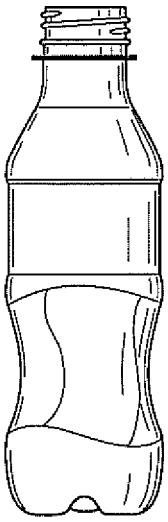
Figure 5D:
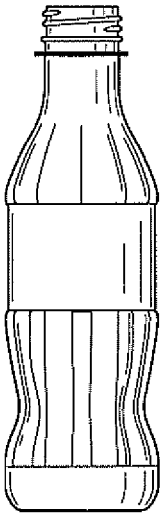
Figure 5E:
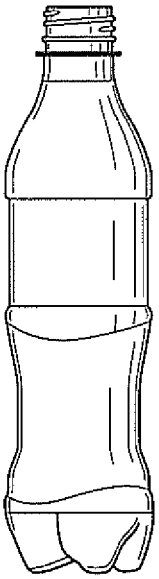

To illustrate various aspects of this disclosure, five small bottles were used for testing physical performance, and this data was used as a benchmark for comparison with containers having the disclosed finish and closure according to this disclosure. These containers (packages or bottles) are designated A through E and are shown pictorially in FIG. 5A through FIG. 5E, with bottles A through E corresponding to FIG. 5A through FIG. 5E, respectively. That is, Bottle A is illustrated at FIG. 5A, Bottle B is illustrated at FIG. 5B, etc. These bottles were used for baseline testing for physical performance and have the specific features as shown in Table 1. Package performance varies due to several factors, including factors related to the bottle and closure. Specifically with respect to the closure, the following are thought to contribute to carbonation loss performance from the container:

1) the diameter of the opening which is covered by the closure, contributing to permeation of $CO_2$ through the closure top-plate (top wall or cover) thickness; and
2) $CO_2$ loss through seal leakage on the sealing surface (at the interface between the closure and the top of the bottle's finish). The latter may be due to several factors such as higher temperatures, imperfections on the interface between the closure and finish materials, and other factors.

TABLE 1

Thermal stability measurements of small OTG (on-the-go) test bottles tested for physical performance

| Parameter | Bottle A | Bottle B | Bottle C | Bottle D | Bottle E |
|---|---|---|---|---|---|
| Nominal volume (mL) | 200 mL | 300 mL | 200 mL | 250 mL | 300 mL |
| Weight (g) | 12 | 17.5 | 17.5 | 23.5 | 15.5 |
| PCO Finish scaled to 22 mm | 1873 | 1881 | 1881 | 1881 | 1873 |
| Thermal Stability, Height (%) | 1.68 | 1.27 | 1.54 | 0.92 | 1.17 |
| Thermal Stability, Mid Panel (%) | 3.17 | 2.00 | 1.45 | 2.26 | 2.31 |

Referring again to Table 1, the closures used in test bottles A and E were proportionally scaled down PCO 1873 closures, which are slightly shorter than the 1881 closures. The remaining bottles B, C, and D, used the proportionally scaled down PCO 1881 closures. The opening diameters of all the bottle finishes in Table 1 were the same, approximately 21.74 mm or nominally, 22 mm. As a results, the finish and closure performance can be compared among all of these test containers. For example, the permeation through the closure top-plate and seal leakage can be tested to benchmark data for the improved designs according to this disclosure.

In one aspect, the finish and closure for small bottles of this disclosure can be less than 28 mm. For example, the T dimension (thread outside of the diameter) of the new bottle finishes can be, or can be about, 27 mm, 26 mm, 25 mm, 24 mm, 23 mm, 22 mm, 21 mm, 20 mm, 19 mm, 18 mm, or even less. A further aspect provides that the T dimension of the new bottle finishes can be, or can be about, 26 mm, 25 mm, 24 mm, 23 mm, or 22 mm.

By way of example, the following table illustrates a comparison among specific finish and closure dimensions and parameters for a standard 28 mm PCO 1881 closure and finish, alongside certain 22 mm closure and finish designs and applications. The dimensions and parameters set out in the first column are illustrated in FIG. 2. Specific finish and closure dimensions and parameters are set out in the second column for a standard 28 mm PCO 1881 closure and finish (1881 CSD). The comparative example of the third column (22 mm proportionally scaled down 1881) presents the calculated data for a finish and closure in which each dimension of a standard 1881 finish is theoretically scaled down or reduced to a proportional fraction ($^{22}/_{28}$) of its original standard 1881 finish. The fourth column provides parameters for Example 1, an inventive 22 mm finish and closure that has been scaled down according to this disclosure, and which provides enhanced performance.

TABLE 2

Comparison of a standard 28 mm PCO 1881 closure and finish parameters with those of exemplary and comparative closures and finishes.

| Dimension (mm) | 28 mm 1881 CSD | Comparative Example 22-mm Proportionally Scaled Down 1881 (theoretical) | Example 1 22-mm Scaled Down According to Disclosure |
|---|---|---|---|
| T | 27.40 | 21.53 | 21.95 |
| E | 24.20 | 19.01 | 19.10 |
| T-E | 1.60 | 1.26 | 1.43 |
| E Wall (E-C) | 1.23 | 0.97 | 1.05 |
| C | 21.74 | 17.08 | 17.00 |
| X | 17.00 | 13.36 | 12.80 |
| Z | 33.00 | 25.93 | 25.00 |
| S | 1.70 | 1.34 | 1.70 |
| D | 11.20 | 8.80 | 8.40 |
| P | 2.70 | 2.12 | 2.50 |
| G | 25.70 | 20.19 | 19.75 |
| F | 24.94 | 19.60 | 19.70 |
| A | 28.00 | 22.00 | 22.80 |
| B1 | 25.71 | 20.20 | 19.50 |
| H | 15.24 | 11.97 | 11.61 |
| Finish-Thread turns (deg) | 650 | 511 | 460 |
| Closure-Thread turns (deg) | | | 550 |
| Finish Weight (g) | 3.74 | 2.94 | 1.76 |
| Closure Weight (g) | 2.40 | 1.89 | 1.42 |
| Carbonation To 4+ Gas Vol | Yes | — | Yes |

As Table 2 illustrates, some of the actual dimensions of the Example 1 inventive 22 mm bottle finish and closure are greater than, and other actual dimensions are less than, the theoretical (proportionally shrunk) PCO 1881 finish. While each of the variations from theoretical (±percentages) can be calculated from the data in Table 2, the variations of selected parameters from theoretical are presented in Table 3. It has been discovered that variations of these selected parameters can provide unexpected improvements in $CO_2$ retention and shelf life. The plus-or-minus (±) differences shown in the following table are percentage are calculated as % Difference=[(Actual−Theoretical)/Theoretical×100%]. Therefore, actual measurements less than theoretical are presented as negative percentage (−%) values and actual measurements greater than theoretical are presented as positive percentage (+%) values.

TABLE 3

Actual 22 mm finish dimensions compared with theoretical (proportionally reduced) 22 mm finish dimensions

| Selected Dimension | % Difference from Theoretical [A] |
|---|---|
| T-E (mm) | +13.5% |
| E Wall (E-C) (mm) | +8.2% |
| S (mm) | +26.9% |
| D (mm) | −4.5% |
| P (mm) | +17.9% |
| B1 (mm) | −3.5% |
| Finish Weight (g) | −40.1% |

[A] % Difference from Theoretical = [(Actual − Theoretical)/Theoretical × 100%].

These Table 2 and Table 3 data illustrate that despite the large reduction in finish weight compared to the theoretical weight, some of the selected dimensions are generally substantially larger than theoretical, a feature that highlights the overall smaller than theoretical dimensions of most of the Table 2 parameters. Therefore, increases or decreases in selected, specific dimensions such as those in Table 4 were discovered to unexpectedly provide substantial improvements in shelf life over what would have been predicted, even when many other dimensions of the finish are reduced to lower weight. Moreover, it is not necessary to increase all of these listed dimensions to achieve the shelf life improvements and still retain lower weight.

On one aspect for example, PET bottles according to this disclosure can have an T-E (mm) dimension that can increase about 5%, about 6%, about 7%, about 8%, about 9%, about 10%, about 11%, about 12%, about 13%, about 14%, about 15%, about 16%, about 17%, about 18%, about 19%, or about 20% over the theoretical dimension in a proportionally scaled down bottle. Moreover, the T-E (mm) dimension can be increased at a value between any of these numbers, inclusive. This parameter can be adjusted independently or simultaneously with any other dimensions or combinations as compared to the theoretical dimension in a proportionally scaled down bottle.

In another aspect, for example, PET bottles according to this disclosure can have an E Wall (E-C) (mm) dimension that can increase about 3%, about 4%, about 5%, about 6%, about 7%, about 8%, about 9%, about 10%, about 11%, about 12%, about 13%, about 14%, about 15%, or about 16%, or even more, over the theoretical dimension in a proportionally scaled down bottle. Moreover, the E Wall (E-C) (mm) dimension can be increased at a value between any of these numbers, inclusive. This parameter can be adjusted independently or simultaneously with any other dimensions or combinations as compared to the theoretical dimension in a proportionally scaled down bottle.

According to a further aspect for example, PET bottles according to this disclosure can have an S (mm) dimension that can increase about 15%, about 16%, about 17%, about 18%, about 19%, about 20%, about 21%, about 22%, about 23%, about 24%, about 25%, about 26%, about 27%, about 28%, about 29%, about 30%, about 31%, about 32%, about 33%, about 34%, or about 35%, over the theoretical dimension in a proportionally scaled down bottle. Moreover, the S (mm) dimension can be increased at a value between any of these numbers, inclusive. This parameter can be adjusted independently or simultaneously with any other dimensions or combinations as compared to the theoretical dimension in a proportionally scaled down bottle.

Yet another aspect of this disclosure provides, for example, PET bottles that can have an D (mm) dimension that, rather than being smaller than the dimension shown in Table 3, can be increased over the theoretical dimension in a proportionally scaled down bottle. In this aspect, the D (mm) dimension can decrease about 1%, about 2%, about 3%, about 4%, about 5%, about 6%, about 7%/a, about 8%, about 9%, or about 10%, over the theoretical dimension in a proportionally scaled down bottle. Moreover, the D (mm) dimension can be decreased at a value between any of these numbers, inclusive. This parameter can be adjusted independently or simultaneously with any other dimensions or combinations as compared to the theoretical dimension in a proportionally scaled down bottle.

A still further aspect provides that, for example, PET bottles according to this disclosure can have a P (mm) dimension that can increase about 8%, about 9%, about 10%, about 11%, about 12%, about 13%, about 14%, about 15%, about 16%, about 17%, about 18%, about 19%, about 20%, about 21%, about 22%, about 23%, about 24%, or about 25% over the theoretical dimension in a proportionally scaled down bottle. Moreover, the P (mm) dimension can be increased at a value between any of these numbers, inclusive. This parameter also may be adjusted independently or simultaneously with any other dimensions or combinations as compared to the theoretical dimension in a proportionally scaled down bottle.

Yet a further aspect provides that, for example, PET bottles according to this disclosure can add a "collar" to the B dimension, such that a portion of the B dimension termed here as B1 is larger than the remaining B dimension. This B1 collar is illustrated in FIGS. 2-4 as having been added to the upper portion of the B dimension. In this aspect, the B1 collar can be expanded by from about 2% to about 12% over the theoretical B dimension in a proportionally scaled down bottle. For example, the bottle can have a B1 collar that can increase about 2%, about 3%, about 4%, about 5%, about 6%, about 7%, about 8%, about 9%, about 10%, about 11%, or about 12% over the theoretical B dimension in a proportionally scaled down bottle. Moreover, the B1 collar dimension can be increased at a value between any of these numbers, inclusive. This parameter also may be adjusted independently or simultaneously with any other dimensions or combinations as compared to the theoretical dimension in a proportionally scaled down bottle.

In another aspect, the proportionally reduced 22 mm 1881 column of Table 2 as compared with the actual data of the inventive 22 mm bottle shows that technical requirements of improved performance of a lightweight bottle are not met by merely scaling down the closure and all of its design dimensions. The finish weight constitutes one particular parameter that can be reduced to provide unexpectedly improved performance. For example, a proportional reduction in finish weight by directly shrinking the 28 mm finish to 22 mm would result in a 2.94 g finish weight, that is, a weight of 79% (22/28) the 3.74 g weight of the starting 1881 finish. This finish weight is substantially higher than preferred for small bottle applications. In contrast, the actual finish weight of the inventive 22 mm finish was 1.76 g, which represents only 47% the starting weight of 3.74 g for the original 1881 finish. The fact that this lighter weight finish provides improvements in shelf life is unexpected because such a large weight reduction typically leads to warping or distortion of the bottle finish at elevated temperatures. It was demonstrated that this light finish design permitted the bottle finish to maintain its structural integrity and not lead to product or gas leakage caused by warping at elevated temperatures (up to 38° C.). This performance was determined in view of physical components of structure (physical performance at a light weight of closure and finish) that prove there is no warping and leakage, thereby showing improvement.

The following table illustrates the weight reduction that is possible using the designs according to the present disclosure. For each opening size less than the conventional 28 mm 1881 finish, both a proportionally scaled down (theoretical) and an inventive (actual) finish weight are shown. Using the weight percentages relative to the conventional 28 mm 1881 finish for both theoretical and actual finishes, the percent improvement over the theoretical is shown.

TABLE 4

Theoretical (proportional) versus actual finish weight reduction and percent improvement over theoretical

| Example | Finish Size (mm) | Theoretical (Proportional) Weight (g) and % of Starting 1881 | Actual Weight (g) and % of Starting 1881 | % Improvement [(Theoretical Actual)/Theoretical × 100] |
|---|---|---|---|---|
| Comparative | 28 mm PCO 1881 standard | 3.74 | 3.74 | — |
| Example 2 | 24 mm | 3.21<br>86% of 1881 | 2.00<br>53% of 1881 | 38% |
| Example 3 | 22 mm | 2.94<br>79% of 1881 | 1.76<br>47% of 1881 | 40% |
| Example 4 | 20 mm | 2.67<br>71% of 1881 | 1.57<br>42% of 1881 | 41% |

The disclosed finishes are also designed specifically to meet other technical processing and engineering requirements. For example, at least for the disclosed 22 mm and 24 mm finishes, when ejecting the part from the injection mold while it is still warm, it has been found that the use of asymmetrical angles on opposite sides of the thread profile provided a beneficial and unexpected results. That is, without this asymmetrical shape, the force necessary to overcome (or jump) the closure thread to eject the part over the protruding steel caused the thread to become slightly flattened on its apex. As a result, the resistant of the finish and closure to blow off when applied to a bottle under pressure from the CSD product was diminished.

The reduction in finish size for the small bottles according to this disclosure also means that available space to incorporate an effective length thread on either the closure or bottle finish may be significantly reduced due to the short height available. This may be a particular issue due to the need to include a tamper evident feature in the closure. Yet, when selected dimensions such as those in Table 2 and Table 3 are altered, and particularly some of the Table 3 parameters are substantially larger than theoretical and others are substantially smaller, the increase in specific dimensions such as those in Table 3 were discovered to unexpectedly provide the ability to maintain the thread pitch as in the PCO 1881 finish and still incorporate adequate thread wrap for successful venting.

Regarding the closure and in particular closure weight, in one aspect, the closure weight of the inventive 22 mm small bottle could be reduced from about 2.4 g for the PCO 1881 finish to about 1.42 g for the 22 mm finish. As Table 2 illustrates, this value is close to that expected in a theoretical, proportionally scaled down closure. However, typically a weight reduction like this would result in gas leakage around the closure seals due to excessive movement caused by doming of the top plate, which is caused by internal pressure in combination with increased temperatures within the bottle. This feature usually prevents 25 mm or 26 mm water bottle closures from being advantageously used for a CSD (carbonated soft drink) product, because the top plate domes and pulls on the seal structure, causing it to lose some contact surface with the bottle finish. This loss of contact surface leads to leakage.

In the finish and closure of this disclosure, the structure of the cap skirt and the thread are designed to resist the increased stress caused by the application torque that may be required to provide the desired seal pressure and integrity. Such designs cannot be achieved with existing light weight caps, such as 25 mm or 26 mm closures for water finishes. In accordance with one aspect, (the so-called C1 version), the closure top plate can be increased in thickness from about 1 mm to about 1.5 mm, which can result in a decrease in the movement of the sealing member and prevent, reduce, or minimize "by-pass" leakage around the seal member. While this may seem to be an obvious change it was unexpected for the increase in top plate thickness to have a "knock-on" effect and reduce movement of the sealing member.

While the improved container finish and closure designs are disclosed primarily for use with carbonated beverages, the disclosed finish and closure designs may also be used in non-carbonated beverage packaging. Examples of suitable non-carbonated beverages that can be packaging with the disclosed designs include, but are not limited to, water, juice, tea, coffee, non-carbonated alcoholic beverages, and the like. By use of the term "beverage" without a qualifier, it is intended to include both carbonated and non-carbonated beverages.

In addition to these various finish and closure dimensional parameters that can be adjusted as indicated in Tables 2 and 3 to provide improved shelf life, the following additional features, embodiments and aspects of the small bottle closure and finish can be used to improve and enhance shelf life and closure and bottle performance in the small bottles. For example, closure features such as closure material and knurling features that enhances ease of opening for small closures. Closure features such as the sealing system for enhanced re-closable and re-sealable performance can be used to enhance performance. Additional finish features such as finish material and venting design can be improved, as can the incorporation of a tamper evident band for the closure.

According to another aspect, various additional features, aspects, and embodiments were found to be substantially particular to small bottle closures and finishes, including the following.

DRINKABILITY. For soft drink CSD packages with reduced serving sizes, the overall drinking experience is considered with a view to providing a similar or improved drinking experience without degrading consumer acceptance. In this aspect, it was found that for small size CSD packages (less than or about 400 ml, or preferably less than about 360 ml), to have the neck finish thread diameter less than or about 26 mm, less than or about 25 mm, less than or about 24 mm, less than or about 23 mm, or about 22 mm provided good drinkability in terms of consumer drinking experience. These diameters also enabled maintaining good bottle filling speeds and bottling line throughputs.

CLOSURE GEOMETRY. In this aspect, for example, the top-plate portion of the closure could be altered in thickness, radii at the corners, and other geometries to provide enhanced sealing performance and reduce permeation and gas loss. It is thought that such changes particularly in thickness and radii at the corners reduced the cantilever effect from doming of the closure under pressure. It has been found that the seal design comprising of an olive-shaped plug seal and an additional external seal lip, make the seal integrity less dependent from the so called "doming effect" and maintains carbonation at least as good as current 28 mm closures.

KNURL PATTERN. The "grippability" of the closure becomes a more pronounced issue with small bottles. When the finish height and diameter are reduced it becomes more difficult to grip the closure for the purpose of opening the package. For example, a 26 mm closure water bottle having a reduced height (10 mm) was found to be difficult to open due to the reduced height and the knurling design. The grippability of a closure during opening and closing were found to be enhanced by, for example, defining and altering the distance between knurls, the knurl geometry, the extent to which the knurls extend from the sides to the top of the closure, and the number of knurls.

Figure 6A:
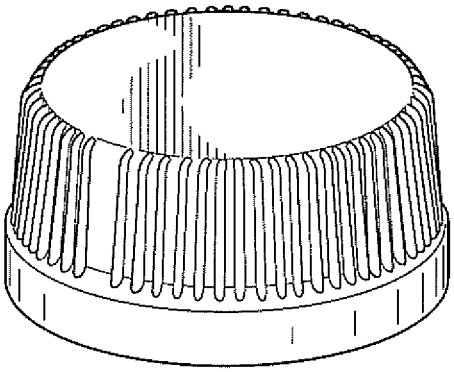
FIG. 6A through FIG. 6H illustrate knurling options tested for the small bottle closures according to this disclosure. Shown are: 60-knurl pattern (FIGS. 6A and 6B), 72-knurl pattern (FIGS. 6C and 6D), 48-knurl pattern (FIGS. 6E and 6F), and 90-knurl pattern (FIGS. 6G and 6H).
Figure 6B:
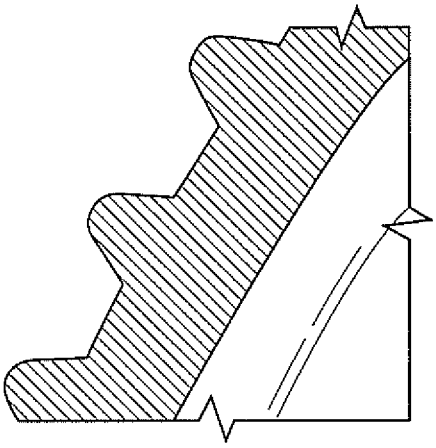
Figure 6C:
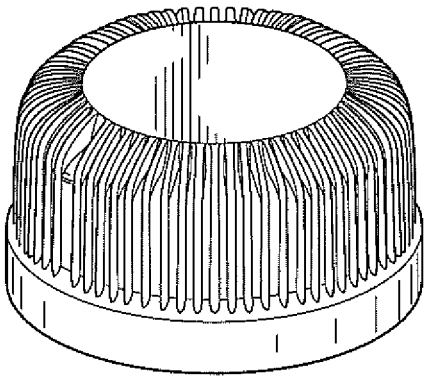
Figure 6D:
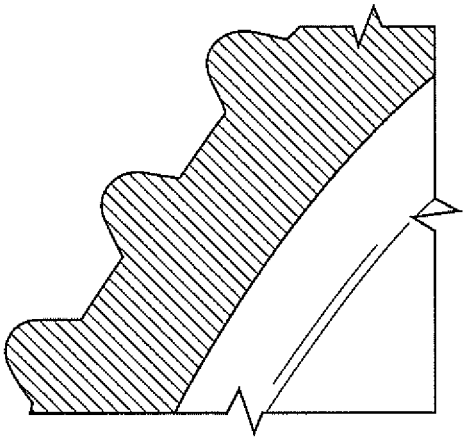
Figure 6E:
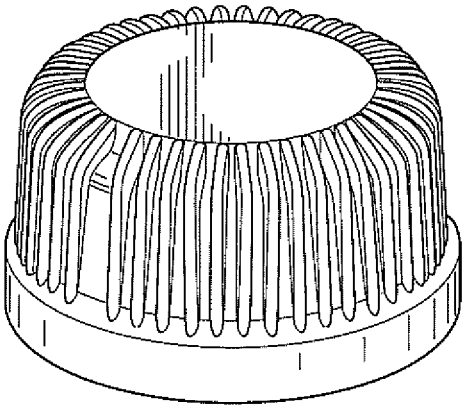
Figure 6F:
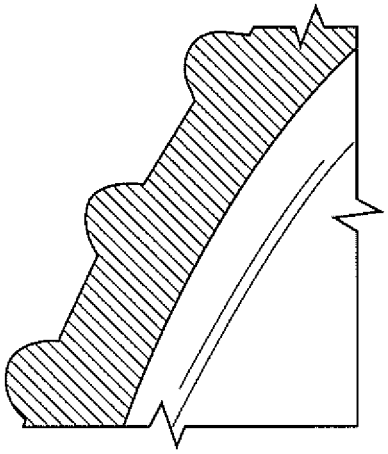
Figure 6G:
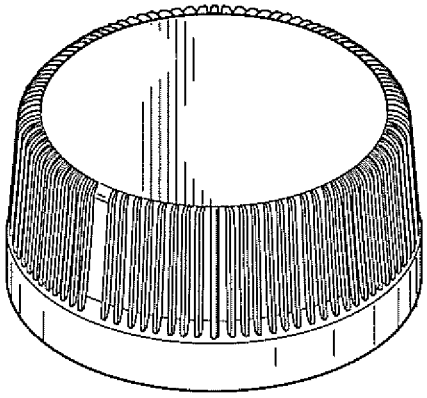
Figure 6H:
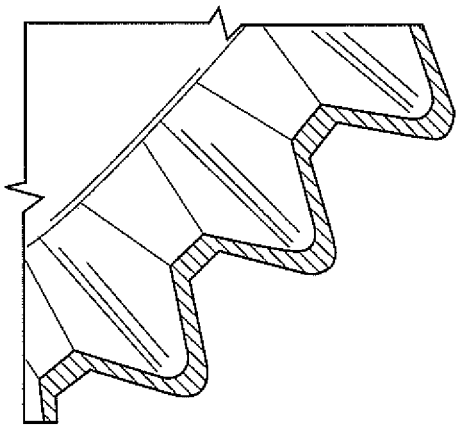
Figure 7:
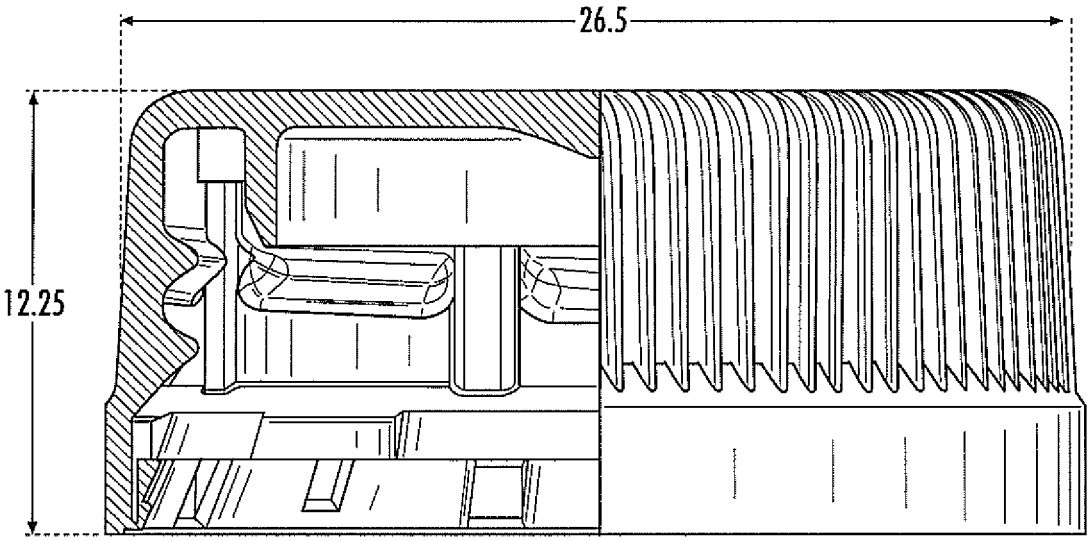
FIG. 7 illustrates one embodiment of a 90-knurl pattern closure for use with the small bottle finishes of this disclosure, having a single start, right hand thread with 4700 turn and a pitch of 2.5 mm.
Figure 8:
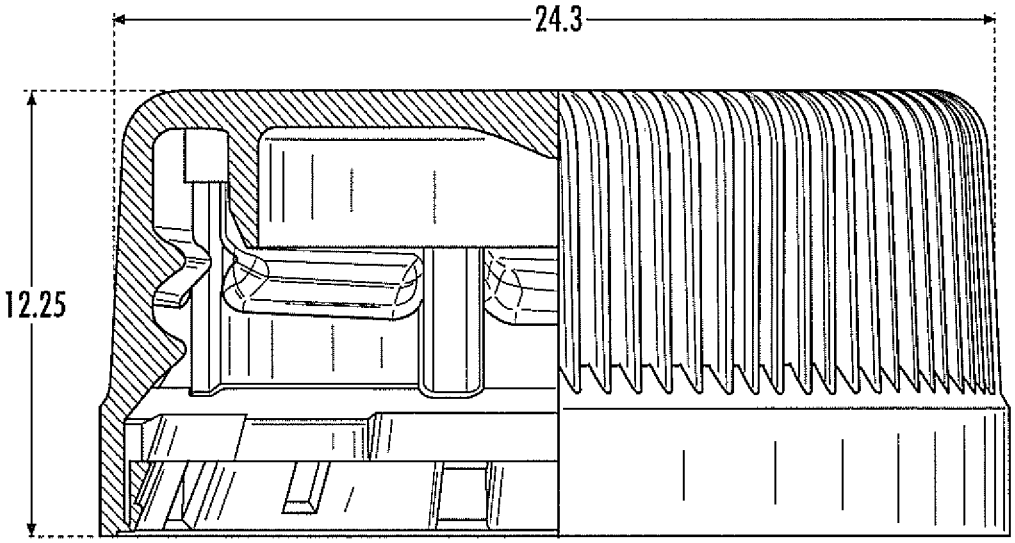
FIG. 8 illustrates a further embodiment of another 90-knurl pattern closure for use with the small bottle finishes of this disclosure, having a single start, right hand thread with 560° turn and a pitch of 2.5 mm.

Examples of knurl patterns that vary according to these features that were found to be useful in the closures of this disclosure are illustrated in FIG. 6A through FIG. 6H. Shown in FIG. 6 are the following: 60-knurl pattern (FIGS. 6A and 6B); 72-knurl pattern (FIGS. 6C and 6D); 48-knurl pattern (FIGS. 6E and 6F); and 90-knurl pattern (FIGS. 6G and 6H). FIG. 7 illustrates one embodiment of a 90-knurl pattern closure for use with the small bottle finishes of this disclosure, having a single start, right hand thread with 470° turn and a pitch of 2.5 mm. FIG. 8 illustrates a further embodiment of another 90-knurl pattern closure for use with the small bottle finishes of this disclosure, having a single start, right hand thread with 560° turn and a pitch of 2.5 mm. In this aspect, for example, a positive element for the opening comfort is the extension of the knurls over the top edge of the cap, regardless of the number of knurls, since this feature provides not only more grip area but enables the consumer to grip the cap from the top or from the top and side.

One aspect of the disclosed cap provides a unique knurling design and pattern that were utilized to overcome this challenge. A computer modeling (FEA) study was used to simulate gripping of the closure to assess the preferred knurl pattern. A closing torque of 10 inch-pounds (in.-lb.) was applied and the openability was ranked for the various designs in terms of applied pressure required to open, hand feel rating, and shear force (grippability). The pressure on the thumb and index finger and the shear force at opening torque to select the preferred knurl pattern to prototype. It was discovered that the use of from about 72 knurl pattern to about a 90 knurl pattern provided good results. Again, FIG. 6A through FIG. 6H illustrate particularly useful closure knurl patterns according to this disclosure that can be used beneficially with the closures of this disclosure.

A series of finish and closure thread wrap designs were found to provide advantageous use with the small bottles of this disclosure. Particularly useful closure systems (finish plus closure) are provided in the following tables, based on the finish and closure shown in the following table.

TABLE 5

Useful closure systems (finish plus closure) provided in this disclosure.

| Finish Version | Finish weight (g) | Finish height (mm) | Threadwrap (degrees) |
|---|---|---|---|
| F1 | 1.76 | 12.8 | 380 |
| F2 | 1.80 | 13.3 | 460 |
| F3 | 2.04 | 14.8 | 620 |
| **Closure version** | **Closure weight (g)** | **Closure Height (mm)** | **Threadwrap (degrees)** |
| C1 | 1.30 | 12.8 | 560 |
| C2 | 1.49 | 13.3 | 720 |

A comparison of the thread differences between particular finish and closure combinations is provided in the following table, for the F1 Finish/C1 Closure (F1/C1); F2 Finish/C1 Closure (F2/C1); and the F3 Finish/C2 Closure (F3/C2), wherein each of these finishes and closures are set out in the previous table.

TABLE 6

Comparison of the thread differences between particular finish and closure combinations described in this disclosure.

| Variation (finish/ closure) | Threadwrap (Finish) (degrees) | Threadwrap (Closure) (degrees) | Engagement (theoretical thread overlap) |
|---|---|---|---|
| F1/C1 | 380 | 560 | 380 |
| F2/C1 | 460 | 560 | 460 |
| F3/C2 | 660 | 720 | 620 |

Figure 9:
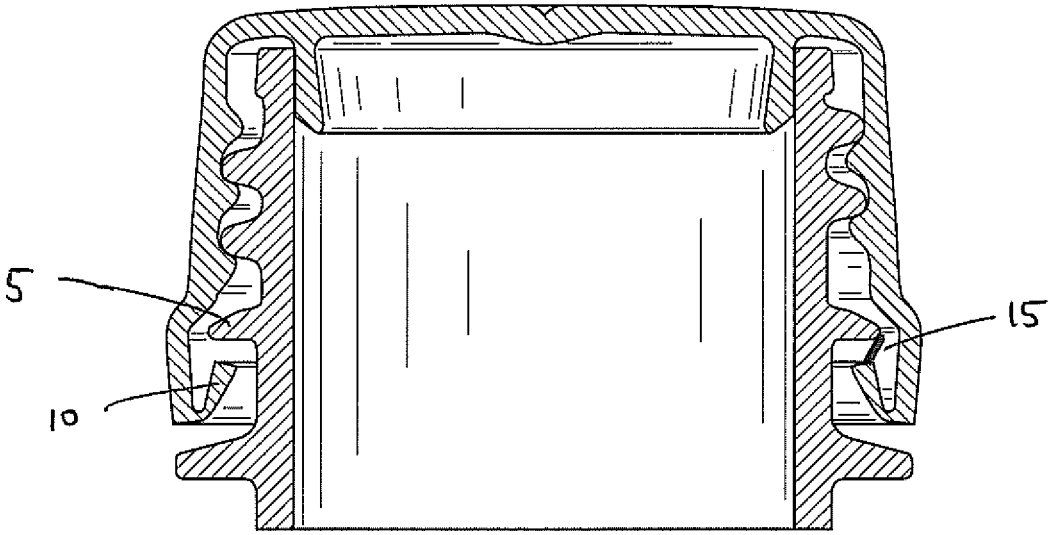
FIG. 9 illustrates a cross section of the Finish/Closure combination with a TE band but without a B1 collar. This image shows the TE bead (5) and how the main TE flap (10) of the closure engages TE band engages the TE bead of the finish when opening, and pushes the TE bead of the finish down when reengaging upon reclosing. A secondary TE flap (15) is illustrated that pushes the TE bead down when re-engaging the closure.
Figure 10:
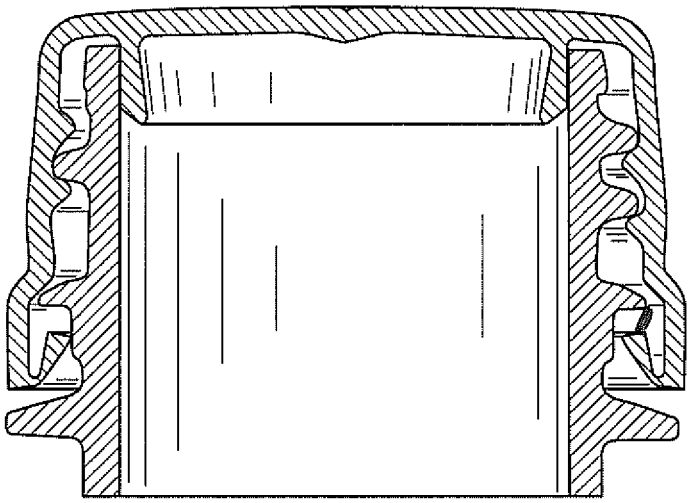
FIG. 10 illustrates a cross section of the F3 Finish/C2 Closure combination with a TE band with a B1 collar. This image also illustrates the main TE flap of the closure engaging the TE bead of the finish and further illustrates how the B1 collar unexpectedly reduces both radial play and axial play. Specifically, the B1 collar was found to reduce radial play to a considerable extent and further was discovered to also reduce axial play.

FIG. 9 illustrates a cross section of the F3 Finish/C2 Closure combination with a TE band but without a B1 collar. This image shows the TE bead (5) and how the main TE flap (10) of the closure engages TE band engages the TE bead of the finish when opening, and pushes the TE bead of the finish down when reengaging upon reclosing. FIG. 10 illustrates a cross section of the F3 Finish/C2 Closure combination with a TE band with a B1 collar. This image also illustrates the main TE flap of the closure engaging the TE bead of the finish and further illustrates how the B1 collar reduces axial play.

FINISH TYPE, FINISH SIZE AND FINISH WEIGHT. Dimensions and geometries that were found to improve overall physical performance include thread engagement, total contact area, thread wrap for preventing blow-offs, friction and thread geometry and profile, as well as overall drinking and consumption experience (see Drinkability above). In one aspect, a weight less than about 1.8 g was achievable by designing a unique geometry specific to consumer needs as described herein, but also meeting physical performance requirements. For example, an E-wall thickness designated as the E-C dimension from tables above of 1.05 mm for a 22 mm opening was found to be particularly useful. This E-wall thickness of 1.05 mm is of course less than the PCO 1881 dimension, but about 8% greater than the proportionally scaled-down PCO 1881 dimension for E-wall thickness. Regarding weight, as described herein, the current PCO 1881 finish for CSD containers weighs 3.8 g. Therefore, by reducing the opening size from 28 mm down to 24 mm, 22 mm, or 20 mm finish weight can also be reduced, either proportionally or non-proportionally based on the theoretical of scaled opening reduction.

Figure 11:
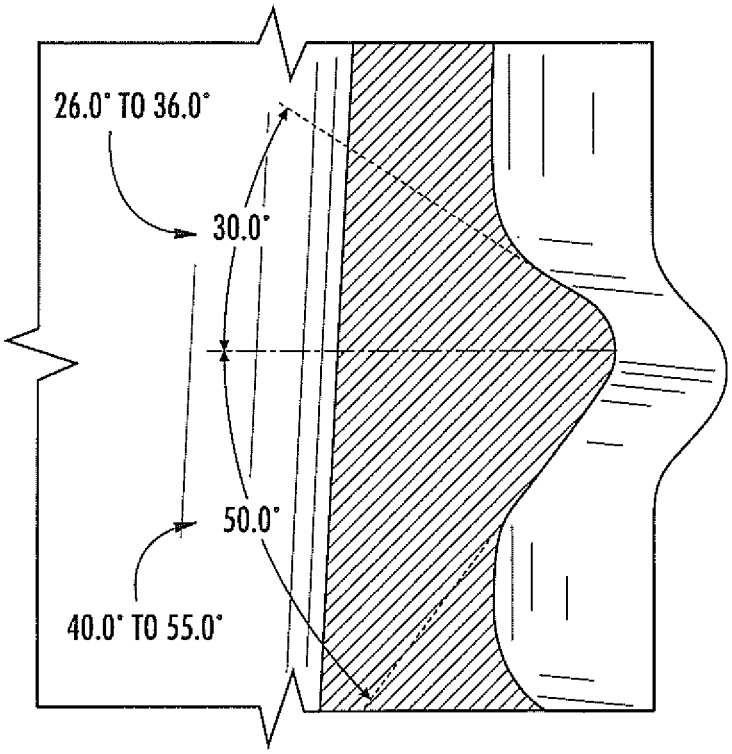
FIG. 11 illustrates a 25 mm or less closure having a specific asymmetric thread geometry to ease de-molding efforts when stripped off the thread core, which further provides enhanced engagement with the thread counterpart of the corresponding neck finish.

THREAD WRAP AND THREAD STRUCTURE. In an aspect, a need was discovered for improving thread engagement at high temperatures which is particular to small bottle closures such as the 24 mm, 22 mm, or 20 mm finishes described herein. For example, it has been found that improved thread engagement can be achieved by: 1) adding thread wrap; 2) changing the thread profile from symmetric to asymmetric; and 3) generally reducing the T and E dimensions and the overall diameter. For example, while embodiments of the 22 mm opening and closure can have a thread wrap of about 460° or 470°, it has been found that by adding about 40°, about 50°, about 60°, about 70°, about 80°, about 90°, about 100°, about 110°, or about 120° can improve thread engagement. One aspect adds about 80° works well to improve thread engagement. Increasing the thread wrap from about 470° to about 550° works well to improve thread engagement. Changing the thread profile from symmetric to asymmetric also works to enhance thread engagement. For example, FIG. 11 illustrates one method of providing an asymmetric thread profile that improves thread engagement. Generally reducing the T and E dimensions and the overall diameter also works to enhance thread engagement. For example, the T (mm) and E (mm) dimension can be decreased about 1%, about 2%, about 3%, about 4%, about 5%, about 6%, about 7%, about 8%, about 9%, about 10%, about 11%, about 12%, about 13%, about 14%, about 15%, about 16%, about 17%, about 18%, about 19% or about 20% over the theoretical dimension in a proportionally scaled down finish and closure. The T and E parameters may be adjusted independently or simultaneously relative to each other or any other dimensions or combinations as compared to the theoretical dimensions. For example, for a 22 mm finish, T and E can be reduced by about 0.1 mm, 0.2 mm, 0.3 mm, or 0.4 mm.

Figure 12:
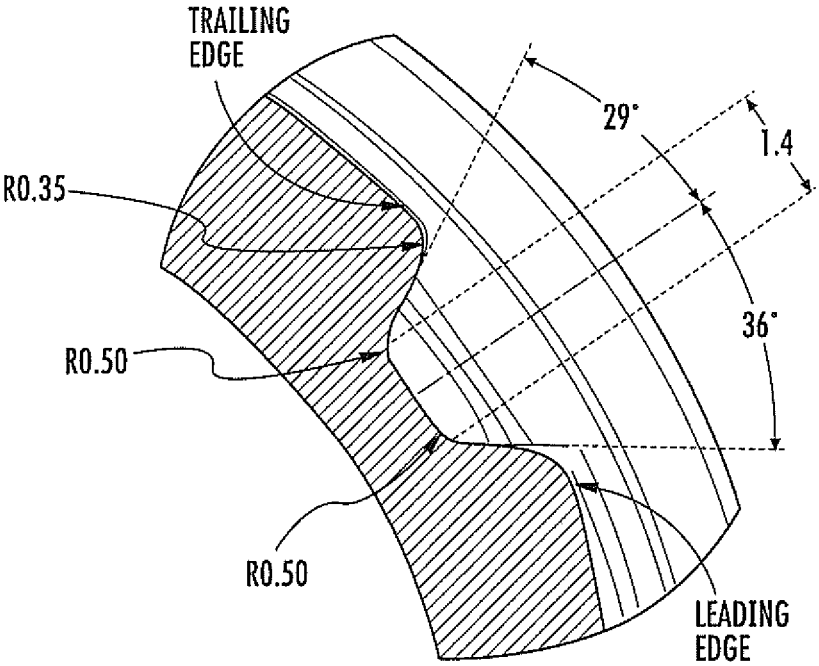
FIG. 12 shows one embodiment disclosed in the disclosure in which a corresponding neck finish with 4 vent slots aligned in the counter-clockwise direction (top view) is shown at the leading edge at less than or about 40° or more preferably less than or about 36° symmetrically from parting line as illustrated, and at the trailing edge at less than or about 35° or more preferably less than or about 27° to 30°, or even more preferably about 29° symmetrically from parting line.
Figure 13:
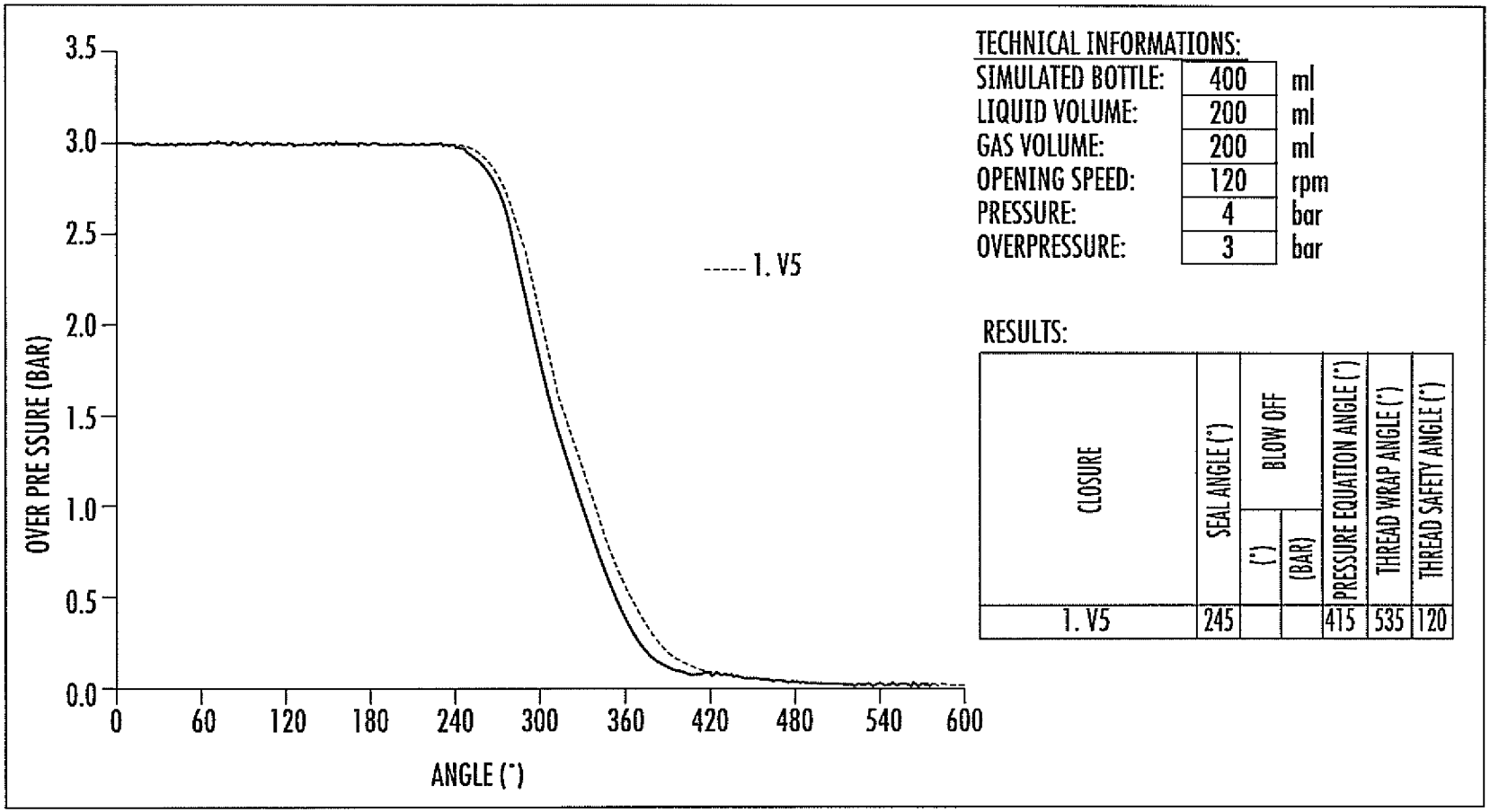
FIG. 13 presents a graph of vent flow and velocity relative to opening angle and progression for an overall vent area neck of 12.88 $mm^2$ and an overall vent area cap of 17.28 $mm^2$. The red and blue curves of FIG. 13 represent data for two samples tested on the OPT (Steinfurth Opening Performance Tester) blow-off test, where pressure is plotted against opening angle, corresponding to time, showing that the closure is still engaged with the finish and no blow-off or closure release has occurred when the pressure is the same inside and outside the container.

VENTING CAPABILITY. The interaction between finish and closure geometry can be altered to adjust the venting capability as is specific to the small bottle opening geometries. For example, in one aspect, there is a unique venting arrangement incorporated on the inner surface of the closure, as illustrated in FIG. 12 This arrangement provides a greater surface area as illustrated by the 29° trailing edge angle and 36° leading edge angle, which maximizes the surface area to allow greater venting. This increased venting, in turn, reduces the likelihood of closure pop off because the bottle is fully vented before the closure and finish are disengaged. FIG. 13 illustrates a plot or graph of vent flow and velocity relative to opening angle and progression for an overall vent area neck of 12.88 $mm^2$ and an overall vent area cap of 17.28 $mm^2$. The red and blue curves of FIG. 13 represent data for two samples tested on the OPT (Steinfurth Opening Performance Tester) blow-off test, where pressure is plotted against opening angle, corresponding to time, showing that the closure is still engaged with the finish and no blow-off or closure release has occurred. The FIG. 13 graph also may also be used to calculate flow rate of the escaping gas during opening.

SEALING SYSTEM AND SEAL SURFACE INTEGRITY. The sealing system including the seal surface integrity can also be changed to improve the small bottle closure and finish. Features such as corner radius and top plate thickness and radius can be altered to provide enhanced sealing performance and reduce permeation and gas loss by preventing $CO_2$ leakage and pressure loss at ambient and high temperatures. Thus, the contact pressure at the closure/finish interface on the sealing surface was examined to infer the seal integrity and for comparison between different geometries on the finish and closure.

Regarding corner radius and top plate thickness, the effect of changes in the corner radius and top plate thickness on seal integrity for the 22-mm closure was examined. It was found that there was no significant difference on inside and outside surface sealing between 1.5 mm thick/1.0 mm radius and 1.0 mm thick/0.5 mm radius (FIG. 14A and FIG. 14B) when the tests were carried out at room temperature. However, at elevated temperature of 38° C., a substantial difference in top sealing performance between these two options was observed, with the heavier wall indicating better seal performance. That is, there was no significant effect on inside and outside surface sealing between these two options at about 23° C. (room temperature). However, it was discovered that the heavier wall indicating measurably better seal performance for the elevated temperature of 38° C. on the top sealing surface.

Figure 14A:
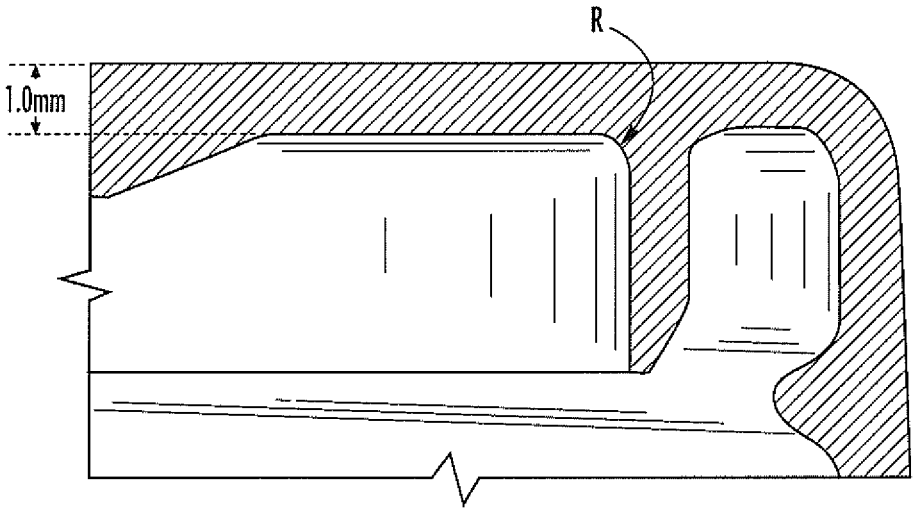
FIG. 14A and FIG. 14B show a partial cross sectional view of closures, comparing the more conventional 1.0 mm thickness/0.5 mm radius (R) closure (FIG. 14A) which has use with large and small bottles, with the 1.5 mm thickness/1.0 mm radius (R) closure (FIG. 14B) which provides better sealing performance with smaller bottles at elevated temperatures.
Figure 14B:
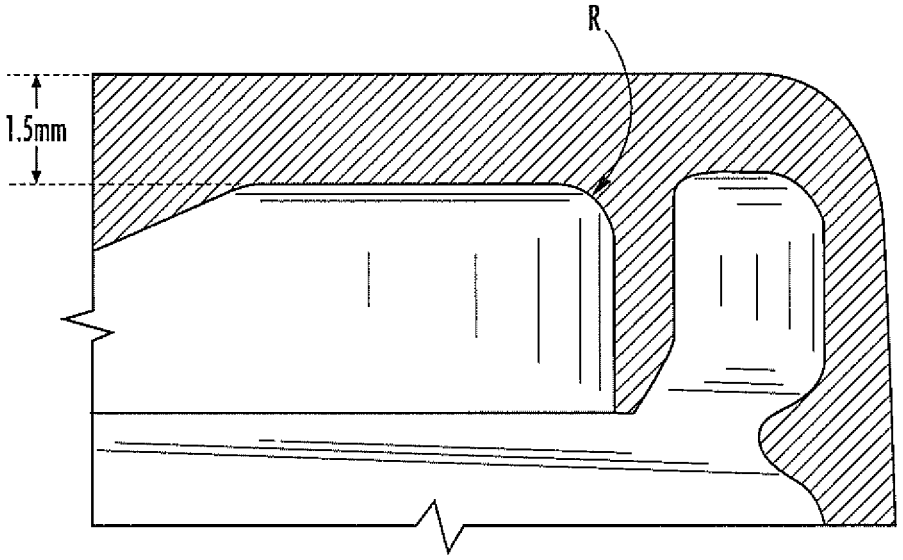
Figure 15:
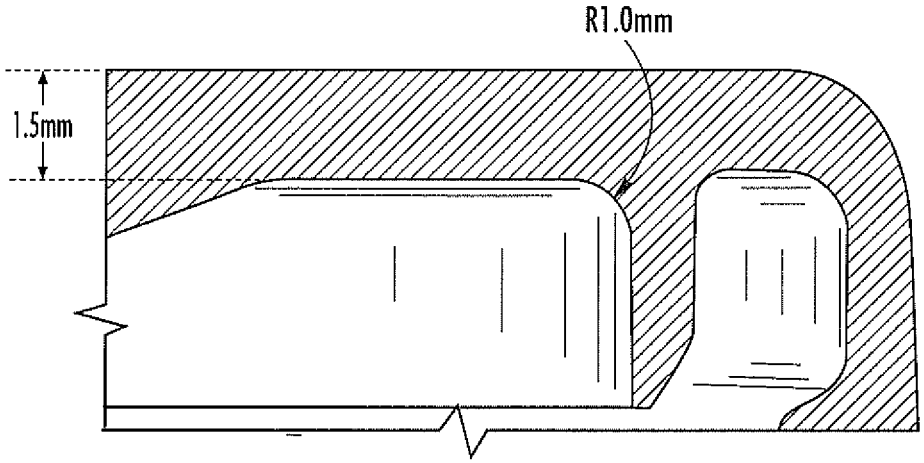
FIG. 15 illustrates a partial cross sectional view the 1.5 mm thickness/1.0 mm radius (R) closure which provides better sealing performance with smaller bottles at elevated temperatures, including the rib option.

Suitable closures cross sectional profiles are illustrated and compared in FIGS. 14-16. FIG. 14A and FIG. 14B show partial cross sectional views of closures, comparing the more conventional 1.0 mm thickness/0.5 mm radius closure which has use with large and small bottles, with the 1.5 mm thickness/1.0 mm radius closure which provides better sealing performance with smaller bottles at elevated temperatures. FIG. 15 illustrates a partial cross sectional view the 1.5 mm thickness/1.0 mm radius closure which provides better sealing performance with smaller bottles at elevated temperatures, including the rib option.

CLOSURE USED WITH SPECIFIC SLIP AGENTS. If desired, slip agents can be used with the closure to enhance openability and recloseability for the closures presented in this disclosure. For example, saturated primary aliphatic fatty amide slip agents (such as behenamide or stearamide) or unsaturated primary aliphatic fatty amide slip agents (such as erucamide or oleamide) can be used. In an aspect, the slip agent can be loaded to a level of about 1000 ppm, about 2000 ppm, or about 3000 ppm. For example, in an aspect, the slip agent behenamide can be used with the closure at 2000 ppm. Due to the decrease in diameter of the small closures as compared to the 28 mm closure, the equivalent force required to turn the closure with the same torque will be higher.

OVERALL PERFORMANCE. When following the design principles set out in this disclosure, it was discovered that the closures for beverage and carbonated beverage bottles having a diameter of less than or about 26 mm, particularly closures for beverage and carbonated beverage bottles having a diameter of less than or about 25 mm, can meet or exceed the requirements of at least one of the ISBT (International Society of Beverage Technologists) elevated cycle test, the ISBT secure seal test, and/or the ISBT pressure retention test for a plastic flat top, inverted, or dome closure at a minimum pressure of 4.0 volumes of carbonation. Further, the closures of this disclosure can also meet or exceed the requirements of at least one of the ISBT (International Society of Beverage Technologists) elevated cycle test, the ISBT secure seal test, and/or the ISBT pressure retention test for a plastic flat top, inverted, or dome closure at a minimum pressure of 4.2 volumes of carbonation. According to a further aspect, it was discovered that the closures of this disclosure can also meet or exceed the requirements of at least two of the ISBT (International Society of Beverage Technologists) elevated cycle test, the ISBT secure seal test, and/or the ISBT pressure retention test for a plastic flat top, inverted, or dome closure at a minimum pressure of 4.0 volumes of carbonation.

The following numbered aspects of the closure are provided, which state various attributes, features, and embodiments of the present disclosure both independently, or in any combination when the context allows. That is, as the context allows, any single numbered aspect and any combination of the following numbered aspects provide various attributes, features, and embodiments of the novel closure.

1. A closure for carbonated beverage bottles, wherein:
the closure has a diameter of less than or about 25 mm; and
the closure meets or exceeds the requirements of at least one of the following ISBT (International Society of Beverage Technologists) tests: elevated cycle test, opening performance test, secure seal test, physical performance test, reference tests, dimensional tests, and/or pressure retention test, for a plastic flat top, inverted, or dome closure at a minimum pressure of 4.0 volumes of carbonation.
2. A closure according to the previous aspect, wherein
the closure meets or exceeds the requirements of at least two of the following ISBT (International Society of Beverage Technologists) tests: elevated cycle test, opening performance test, secure seal test, physical performance test, reference tests, dimensional tests, and/or pressure retention test, for a plastic flat top, inverted, or dome closure at a minimum pressure of 4.0 volumes of carbonation.
3. A closure according to any of the previous aspects as the context allows, wherein the closure is a one-piece closure.
4. A closure according to any of the previous aspects as the context allows, wherein the closure is a two-piece closure.
5. A closure according to any of the previous aspects as the context allows, wherein the closure comprises polyolefin, plasticized thermoplastic, or polystyrene and has a weight less than or about 1.42 grams.
6. A closure according to any of the previous aspects as the context allows, wherein the closure top-plate thickness does not exceed about 1.1 mm.
7. A closure according to any of the previous aspects as the context allows, wherein the closure comprises an asymmetrical thread profile.
8. A closure according to any of the previous aspects as the context allows, wherein the closure comprises a symmetrical thread profile.
9. A closure according to any of the previous aspects as the context allows, wherein the closure comprises 2 or more vent slots distributed over the inner cap circumference.
10. A closure according to any of the previous aspects as the context allows, wherein the closure comprises from 2 to 20 vent slots, or alternatively, from 4 to 16 vent slots, distributed over the inner cap circumference.
11. A closure according to any of the previous aspects as the context allows, wherein the closure provides a 2.2 mm lead (pitch) accommodating a thread wrap between about 360° and 720°.
12. A closure according to any of the previous aspects as the context allows, wherein the closure provides a 2.2 mm lead (pitch) accommodating a thread wrap between about 550° and 720°.
13. A closure according to any of the previous aspects as the context allows, wherein the closure comprises a symmetrical thread profile and provides a 2.2 mm lead (pitch).
14. A closure according to any of the previous aspects as the context allows, wherein the closure comprises a symmetrical thread profile an provides a 2.2 mm lead (pitch) accommodating a thread wrap between about 710° and 760°.
15. A closure according to any of the previous aspects as the context allows, wherein:
a) the closure has from 2 to 20 vent slots, or alternatively, from 4 to 16 vent slots, distributed over the inner cap circumference;
b) the closure comprises a polyolefin and has a weight less than or about 1.42 grams; and
c) the closure has a top-plate thickness that does not exceed 1.3 mm.

The numbered aspects of the finish that follow are also provided, which state various attributes, features, and embodiments of the present disclosure both independently, or in any combination when the context allows. That is, as the context allows, any single numbered aspect and any combination of the following numbered aspects provide various attributes, features, and embodiments of the novel finish.

1. A neck finish for beverage (carbonated and non-carbonated beverage) bottles, wherein
the neck finish comprises a diameter (d) of less than or about 25 mm, from 2 to 20 vent slots (inclusive), or alternatively, from 4 to 16 vent slots, aligned in the counter-clockwise direction (top view) at the leading edge that is less than, equal to, or greater than the trailing edge from the parting line.
2. A neck finish according to the previous aspect, wherein the leading edge is not less than the trailing edge from the parting line.
3. A neck finish according to any of the previous aspects as the context allows, wherein the leading edge is less than or about 40° symmetrically disposed from the parting line, and at the trailing edge is less than or about 35° symmetrically disposed from the parting line.
4. A neck finish according to any of the previous aspects as the context allows, wherein the T-E dimension of the neck finish is modified by +5% to +20% from a theoretical T-E dimension of a standard 28 mm PCO 1881 finish that is proportionally scaled down by a factor of d/28, wherein d is the diameter (mm) of the neck finish of less than or about 25 mm.
5. A neck finish according to any of the previous aspects as the context allows, wherein the E Wall (E-C) dimension of the neck finish is modified by +3% to +16% from a theoretical E Wall (E-C) dimension of a standard 28 mm PCO 1881 finish that is proportionally scaled down by a factor of d/28, wherein d is the diameter (mm) of the neck finish of less than or about 25 mm.
6. A neck finish according to any of the previous aspects as the context allows, wherein the S dimension of the neck finish is modified by +15% to +35% from a theoretical S dimension of a standard 28 mm PCO 1881 finish that is proportionally scaled down by a factor of d/28, wherein d is the diameter (mm) of the neck finish of less than or about 25 mm.

7. A neck finish according to any of the previous aspects as the context allows, wherein the D dimension of the neck finish is modified by −1% to −10% from a theoretical D dimension of a standard 28 mm PCO 1881 finish that is proportionally scaled down by a factor of d/28, wherein d is the diameter (mm) of the neck finish of less than or about 25 mm.
8. A neck finish according to any of the previous aspects as the context allows, wherein the P dimension of the neck finish is modified by +8% to +25% from a theoretical P dimension of a standard 28 mm PCO 1881 finish that is proportionally scaled down by a factor of d/28, wherein d is the diameter (mm) of the neck finish of less than or about 25 mm.
9. A neck finish according to any of the previous aspects as the context allows, wherein a B1 collar is added to the B dimension of the neck finish, the B1 collar being larger by +2% to +12% than a theoretical B dimension of a standard 28 mm PCO 1881 finish that is proportionally scaled down by a factor of d/28, wherein d is the diameter (mm) of the neck finish of less than or about 25 mm.

According to further aspects, specific features and embodiments of the present disclosure include the following.

1. A closure for beverage (carbonated and non-carbonated beverage) bottles having a diameter of less than or about 25 mm, the closure further having one or any combination of the following properties:
   a) the closure comprises polyolefin, plasticized thermoplastic, or polystyrene and has a weight less than or about 1.42 grams;
   b) the closure top-plate thickness does not exceed about 1.3 mm;
   c) the closure comprises an asymmetrical thread profile;
   d) the closure comprises from 2 to 20 vent slots, or alternatively, from 4 to 16 vent slots, distributed over the inner cap circumference; and/or
   e) the closure provides a 2.2 mm lead (pitch).
2. A closure for beverage bottles according to the previous aspect as the context allows, wherein the closure is further characterized by a top-plate thickness that does not exceed about 1.1 mm.
3. A closure for beverage bottles according to any of the previous aspects as the context allows, wherein the closure meets or exceeds the requirements of at least one of the following ISBT (International Society of Beverage Technologists) tests: elevated cycle test, opening performance test, secure seal test, physical performance test, reference tests, dimensional tests, and/or pressure retention test, for a plastic flat top, inverted, or dome closure at a minimum pressure of 4.0 volumes of carbonation.
4. A closure for beverage bottles according to any of the previous aspects as the context allows, wherein the closure meets or exceeds the requirements of at least one of the following ISBT (International Society of Beverage Technologists) tests: elevated cycle test, opening performance test, secure seal test, physical performance test, reference tests, dimensional tests, and/or pressure retention test, for a plastic flat top, inverted, or dome closure at a minimum pressure of 4.0 volumes of carbonation.
5. A closure for beverage bottles according to any of the previous aspects as the context allows, wherein the closure is a one-piece closure.
6. A closure for beverage bottles according to any of the previous aspects as the context allows, wherein the closure is a two-piece closure.
7. A closure for beverage bottles according to any of the previous aspects as the context allows, wherein the closure comprises 2 or more vent slots distributed over the inner cap circumference.
8. A closure for beverage bottles according to any of the previous aspects as the context allows, wherein the closure comprises from 2 to 20 vent slots, or alternatively, from 4 to 16 vent slots, distributed over the inner cap circumference.
9. A closure for beverage bottles according to any of the previous aspects as the context allows, wherein the closure accommodates a thread wrap between about 360° and 720°.
10. A closure for beverage bottles according to any of the previous aspects as the context allows, wherein the closure accommodates a thread wrap between about 550° and 720°.

As used in the specification and the appended claims, the singular forms "a," "an," and "the" include plural referents, unless the context clearly dictates otherwise. Thus, for example, reference to "a vent" includes a single vent as well as any combination of more than one vent if the context indicates or allows, such as the use of multiple vents simultaneously or in combination.

Throughout the specification and claims, the word "comprise" and variations of the word, such as "comprising" and "comprises," means "including but not limited to," and is not intended to exclude, for example, other additives, components, elements, or steps. While compositions and methods are described in terms of "comprising" various components or steps, the compositions and methods can also "consist essentially of" or "consist of" the various components or steps.

Reference throughout this specification to "one embodiment," "an embodiment," or "embodiments" means that a particular feature, structure, or characteristic described in connection with the embodiment is included in at least one embodiment. Thus, the appearances of the phrases "in one embodiment" or "in an embodiment" in various places in the specification are not necessarily all referring to the same embodiment. Furthermore, the particular features, aspects, structures, or characteristics may be combined in any suitable manner in one or more embodiments.

"Optional" or "optionally" means that the subsequently described element, component, step, or circumstance can or cannot occur, and that the description includes instances where the element, component, step, or circumstance occurs and instances where it does not.

Throughout this specification, various publications may be referenced. The disclosures of these publications are hereby incorporated by reference in pertinent part, in order to more fully describe the state of the art to which the disclosed subject matter pertains. The references disclosed are also individually and specifically incorporated by reference herein for the material contained in them that is discussed in the sentence in which the reference is relied upon. To the extent that any definition or usage provided by any document incorporated herein by reference conflicts with the definition or usage applied herein, the definition or usage applied herein controls.

Unless indicated otherwise, when a range of any type is disclosed or claimed, for example a range of the sizes, number, percentages, and the like, it is intended to disclose or claim individually each possible number that such a range could reasonably encompass, including any sub-ranges or combinations of sub-ranges encompassed therein. When describing a range of measurements such as sizes or percentages, every possible number that such a range could reasonably encompass can, for example, refer to values within the range with one significant figure more than is present in the end points of a range, or refer to values within the range with the same number of significant figures as the end point with the most significant figures, as the context indicates or permits. For example, when describing a range of percentages such as from 5% to 15%, it is understood that this disclosure is intended to encompass each of 5%, 6%, 7%, 8%, 9%, 10%, 11%, 12%, 13%, 14%, and 15%, as well as any ranges, sub-ranges, and combinations of sub-ranges encompassed therein. Applicants' intent is that these two methods of describing the range are interchangeable. Accordingly, Applicants reserve the right to proviso out or exclude any individual members of any such group, including any sub-ranges or combinations of sub-ranges within the group, if for any reason Applicants choose to claim less than the full measure of the disclosure, for example, to account for a reference that Applicants are unaware of at the time of the filing of the application.

Values or ranges may be expressed herein as "about", from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed therein, and that each value is also herein disclosed as "about" that particular value in addition to the value itself. In another aspect, use of the term "about" means±20% of the stated value, ±15% of the stated value, ±10% of the stated value, ±5% of the stated value, or ±3% of the stated value.

In any application before the United States Patent and Trademark Office, the Abstract of this application is provided for the purpose of satisfying the requirements of 37 C.F.R. § 1.72 and the purpose stated in 37 C.F.R. § 1.72(b) "to enable the United States Patent and Trademark Office and the public generally to determine quickly from a cursory inspection the nature and gist of the technical disclosure." Therefore, the Abstract of this application is not intended to be used to construe the scope of the claims or to limit the scope of the subject matter that is disclosed herein. Moreover, any headings that are employed herein are also not intended to be used to construe the scope of the claims or to limit the scope of the subject matter that is disclosed herein. Any use of the past tense to describe an example otherwise indicated as constructive or prophetic is not intended to reflect that the constructive or prophetic example has actually been carried out.

Those skilled in the art will readily appreciate that many modifications are possible in the exemplary embodiments disclosed herein without materially departing from the novel teachings and advantages according to this disclosure. Accordingly, all such modifications and equivalents are intended to be included within the scope of this disclosure as defined in the following claims. Therefore, it is to be understood that resort can be had to various other aspects, embodiments, modifications, and equivalents thereof which, after reading the description herein, may suggest themselves to one of ordinary skill in the art without departing from the spirit of the present disclosure or the scope of the appended claims.

We claim:

1. A closure for carbonated beverage bottles, wherein:
the closure has a diameter of less than or about 25 mm;
the closure has a weight less than or about 1.42 grams;
the closure has a top-plate thickness that does not exceed about 1.1 mm;
the closure comprises 2 or more vent slots distributed over an inner cap circumference;
the closure provides a 2.2 mm lead (pitch); and
the closure meets or exceeds the requirements of at least one of the following ISBT (International Society of Beverage Technologists) tests: elevated cycle test, opening performance test, secure seal test, physical performance test, reference tests, dimensional tests, and/or pressure retention test, for a plastic flat top, inverted, or dome closure at a minimum pressure of 4.0 volumes of carbonation.

2. A closure according to claim 1, wherein
the closure meets or exceeds the requirements of at least two of the following ISBT (International Society of Beverage Technologists) tests: elevated cycle test, opening performance test, secure seal test, physical performance test, reference tests, dimensional tests, and/or pressure retention test, for a plastic flat top, inverted, or dome closure at a minimum pressure of 4.0 volumes of carbonation.

3. A closure according to claim 1, wherein the closure is a one-piece closure.

4. A closure according to claim 1, wherein the closure is a two-piece closure.

5. A closure according to claim 1, wherein the closure comprises polyolefin, plasticized thermoplastic, or polystyrene.

6. A closure according to claim 1, wherein the closure comprises an asymmetrical thread profile.

7. A closure according to claim 1, wherein the closure comprises a symmetrical thread profile.

8. A closure according to claim 1, wherein the closure comprises from 2 to 20 vent slots distributed over the inner cap circumference.

9. A closure according to claim 1, wherein the closure provides a 2.2 mm lead (pitch) accommodating a thread wrap between about 360° and 720°.

10. A closure according to claim 1, wherein the closure provides a 2.2 mm lead (pitch) accommodating a thread wrap between about 550° and 720°.

11. A closure according to claim 1, wherein the closure comprises a symmetrical thread profile and provides a 2.2 mm lead (pitch).

12. A closure according to claim 1, wherein the closure comprises a symmetrical thread profile and provides a 2.2 mm lead (pitch) accommodating a thread wrap between about 710° and 760°.

13. A closure according to claim 1, wherein:
a) the closure has from 2 to 20 vent slots distributed over the inner cap circumference;
b) the closure comprises a polyolefin and has a weight less than or about 1.42 grams; and
c) the closure has a top-plate thickness that does not exceed 1.3 mm.

14. A closure for carbonated beverage bottles having a diameter of less than or about 25 mm, the closure further having one or any combination of the following properties:

a) the closure comprises polyolefin, plasticized thermoplastic, or polystyrene and has a weight less than or about 1.42 grams;

b) the closure top-plate thickness does not exceed about 1.3 mm;

c) the closure comprises an asymmetrical thread profile;

d) the closure comprises from 2 to 20 vent slots distributed over the inner cap circumference; and/or e) the closure provides a 2.2 mm lead (pitch).

15. A closure according to claim 14, wherein the closure is further characterized by a top-plate thickness that does not exceed about 1.1 mm.

16. A closure according to claim 14, wherein:

the closure meets or exceeds the requirements of at least one of the following ISBT (International Society of Beverage Technologists) tests: elevated cycle test, opening performance test, secure seal test, physical performance test, reference tests, dimensional tests, and/or pressure retention test, for a plastic flat top, inverted, or dome closure at a minimum pressure of 4.0 volumes of carbonation.

17. A closure according to claim 14, wherein:

the closure meets or exceeds the requirements of at least two of the following ISBT (International Society of Beverage Technologists) tests: elevated cycle test, opening performance test, secure seal test, physical performance test, reference tests, dimensional tests, and/or pressure retention test, for a plastic flat top, inverted, or dome closure at a minimum pressure of 4.0 volumes of carbonation.

18. A closure according to claim 14, wherein the closure is a one-piece closure.

19. A closure according to claim 14, wherein the closure is a two-piece closure.

20. A closure according to claim 14, wherein the closure comprises 2 or more vent slots distributed over the inner cap circumference.

21. A closure according to claim 14, wherein the closure comprises from 2 to 20 vent slots distributed over the inner cap circumference.

22. A closure according to claim 14, wherein the closure accommodates a thread wrap between about 360° and 720°.

23. A closure according to claim 14, wherein the closure accommodates a thread wrap between about 550° and 720°.

24. A closure for carbonated beverage bottles, wherein:

the closure has a diameter of less than or about 25 mm;

the closure has a weight less than or about 1.42 grams;

the closure has a top-plate thickness that does not exceed about 1.1 mm;

the closure comprises 2 or more vent slots distributed over an inner cap circumference;

the closure provides a 2.2 mm lead (pitch);

the closure is configured to seal a bottle having a neck finish comprising:

a diameter (d) of less than or about 25 mm, from 2 to 20 vent slots (inclusive) aligned in the counter-clockwise direction (top view), a parting line bisecting the vent slot radially, a first angle defining the leading edge of a vent slot relative to the parting line, and a second angle defining the trailing edge of a vent slot relative to the parting line, wherein the first and second angles are positive, and the first angle is greater than the second angle; and the closure meets or exceeds the requirements of at least one of the following ISBT (International Society of Beverage Technologists) tests: elevated cycle test, opening performance test, secure seal test, physical performance test, reference tests, dimensional tests, and/or pressure retention test, for a plastic flat top, inverted, or dome closure at a minimum pressure of 4.0 volumes of carbonation.

* * * * *